United States Patent [19]

Shelton

[11] Patent Number: 4,609,012

[45] Date of Patent: Sep. 2, 1986

[54] SERVO VALVE

[75] Inventor: John J. Shelton, Tuttle, Okla.

[73] Assignee: Robert L. Fife, Fort Worth, Tex.

[21] Appl. No.: 661,914

[22] Filed: Oct. 17, 1984

Related U.S. Application Data

[63] Continuation-in-part of Ser. No. 428,668, Sep. 30, 1982, abandoned.

[51] Int. Cl.[4] ..... F16K 11/065; F16K 31/126

[52] U.S. Cl. ..... 137/625.66; 137/625.25; 137/625.62; 251/337; 267/160

[58] Field of Search ..... 137/625.25, 625.62, 137/625.66; 226/7, 22; 251/337; 267/160

[56] References Cited

U.S. PATENT DOCUMENTS

| | | | |
|---|---|---|---|
| 2,883,176 | 4/1959 | Bernstein | 267/160 X |
| 3,071,157 | 1/1963 | Robertson et al. | 137/625.24 |
| 3,098,595 | 7/1963 | Shelton | 226/22 |
| 3,159,170 | 12/1964 | Callan | 137/82 |
| 3,674,236 | 7/1972 | Commarmot | 251/176 |
| 3,701,365 | 10/1972 | Abdo | 137/625.43 |
| 4,322,063 | 3/1982 | Fischbeck et al. | 267/160 |

FOREIGN PATENT DOCUMENTS

| | | | |
|---|---|---|---|
| 1120711 | 12/1961 | Fed. Rep. of Germany | 267/160 |

OTHER PUBLICATIONS

Fluid Power Control (Blackburn et al., MIT Press, 1960, pp. 241 and 242).

Lee, Shih-Ying, "Contributions to Hydraulic Control"; American Society of Mechanical Engineers Transactions, vol. 76 (1954), pp. 905-911.

*Primary Examiner*—A. Michael Chambers
*Assistant Examiner*—John C. Fox
*Attorney, Agent, or Firm*—Eugene M. Eckelman

[57] ABSTRACT

A housing has an inner area defined by end walls, side walls, a top wall, and a bottom wall having a flat inner surface. Inlet and outlet ports open through the flat inner surface. The inlet port is arranged to be connected to a supply source of pneumatic pressure and the outlet ports are arranged to be connected to an actuator. A control member in the housing has a pair of recesses facing the inner surface in association with the inlet and outlet ports. The control member is suspended by a pair of leaf springs which allow a high response of the control member with a low signal pressure. The leaf springs are engineered and tested precisely considering the compression or columnar force acting endwise thereon as a result of the working pressure in the valve. At the same time the leaf springs have lateral deflection sufficient for operation of the control member 54 without buckling. A diaphragm is controlled by a pneumatic correction signal force from a low pressure sensor circuit and is arranged under the influence of such signal force to selectively position the control member relative to the inlet and outlet ports for controlling power to the actuator.

2 Claims, 5 Drawing Figures

SERVO VALVE

REFERENCE TO PRIOR APPLICATIONS

This application is a continuation-in-part of application Ser. No. 428,668, filed Sept. 30, 1982 now abandoned.

BACKGROUND OF THE INVENTION

This invention relates to new and useful improvements in pneumatic servo valves used with automatic web guiding systems.

Automatic web guiding systems are used to control the lateral position of moving webs of material, such as paper, plastics, textiles and other flexible materials being processed in continuous or roll form. A signal is generated by the position of the web edge relative to a sensor, and the signal output either directly controls an actuator connected to positioning means or indirectly controls an actuator through a servo valve which is connected to a web positioner.

Various types of servo valves have been incorporated into automatic web guiding systems to control the operation of actuator means, such as a spool type servo valve. The primary problem of the spool type pneumatic valve is the sticking due to friction and contamination from the air. In comparison to hydraulic valves, the pneumatic valve lacks the flushing and lubrication provided by the hydraulic fluid of a hydraulic valve.

Most all-pneumatic automatic web guiding systems have not used servo valves, but have operated their actuators directly with "feeler" type sensors that ride on the web edge, or an open vacuum type sensor which has one or more "intake" orifices supporting the web edge. Both systems are used in conjunction with spring-opposed single acting actuators.

A low pressure, non-contact pneumatic web sensor is highly desirable for sensing thin, delicate webs. Such a sensor requires a servo valve to provide the air pressure and flow necessary to operate an actuator for web controlling means.

The idea of a suspension valve is not new or unique. For example, *Fluid Power Control,* (Blackburn, Reethof, and Shearer, M.I.T. Press, 1960, p. 241.) describes a small suspension valve in which the flexure hinges, the stationary support block, and the moving block are all machined from a single block. A similar suspension valve is shown in a publication of American Society of Mechanical Engineers Transactions, Vol. 76 (1954) pp. 907, authored by Shih-Ying Lee. These devices utilize rigid suspension columns with cut-out portions which form hinges. The type of structure shown in Blackburn and Lee has severe flexure limitations and is limited and essentially unsuited as an automatic guiding system servo valve. Furthermore, the single block construction and portage configuration make this valve costly to manufacture and assemble. Other types of valves have been used such as shown in U.S. Pat. No. 3,674,236 which utilize flexible blades in tension that maintain a valve block in a position such that valve parts can be maintained in slidable, frictional, working engagement. This friction engagement for obvious reasons defeats use of this type of valve with a low pressure air signal system.

SUMMARY OF THE INVENTION

According to the invention and forming a primary objective thereof, a friction free servo valve is provided with increased flexure and improved flow. Such increased flexure and improved flow makes the valve practical with a low-pressure air signal system.

Another object of the invention is to provide a valve of the type described that is capable of precise and accurate manufacture and is easily assembled and disassembled.

Another object of the invention is to provide a valve of the type described that is not affected in its operation by the usual type contaminants that may be present in air systems such as dust.

In carrying out the objectives of the invention, a housing has inlet and outlet ports opening into an inner surface thereof, and a control member is enclosed in the housing and has a pair of recesses facing such inner surface in association with inlet and outlet ports. Leaf spring suspension means suspend the control member from the top wall of the housing and hold it operatively in close but spaced relation to the inner surface. Due to the inherent flexibility of leaf springs, such suspension means allows a high response of the control member to a low signal pressure and at the same time such suspension can be predictably and analytically engineered to withstand the column strength or compressive force acting on the leaf springs and yet allow the lateral deflection which is necessary for operation of the control member without buckling. The housing includes movable pressure responsive means controlled by pneumatic correction signals from a sensor. The pressure responsive means operatively engages the control member laterally relative to the resilient suspension means and is arranged under the influence of the pneumatic correction signal force from the sensor to selectively position the control member relative to the inlet and outlet ports for controlling power to actuator means. The control member and the inner surface of the housing have a novel cooperating relationship which provides an efficient operation of the actuator means in response to a sensor signal as well as an efficient and accurate construction and assembly.

The invention will be better understood and additional objects and advantages will become apparent from the following description taken in connection with the accompanying drawings.

DETAILED DESCRIPTION OF A PREFERRED EMBODIMENT

Figure 5:
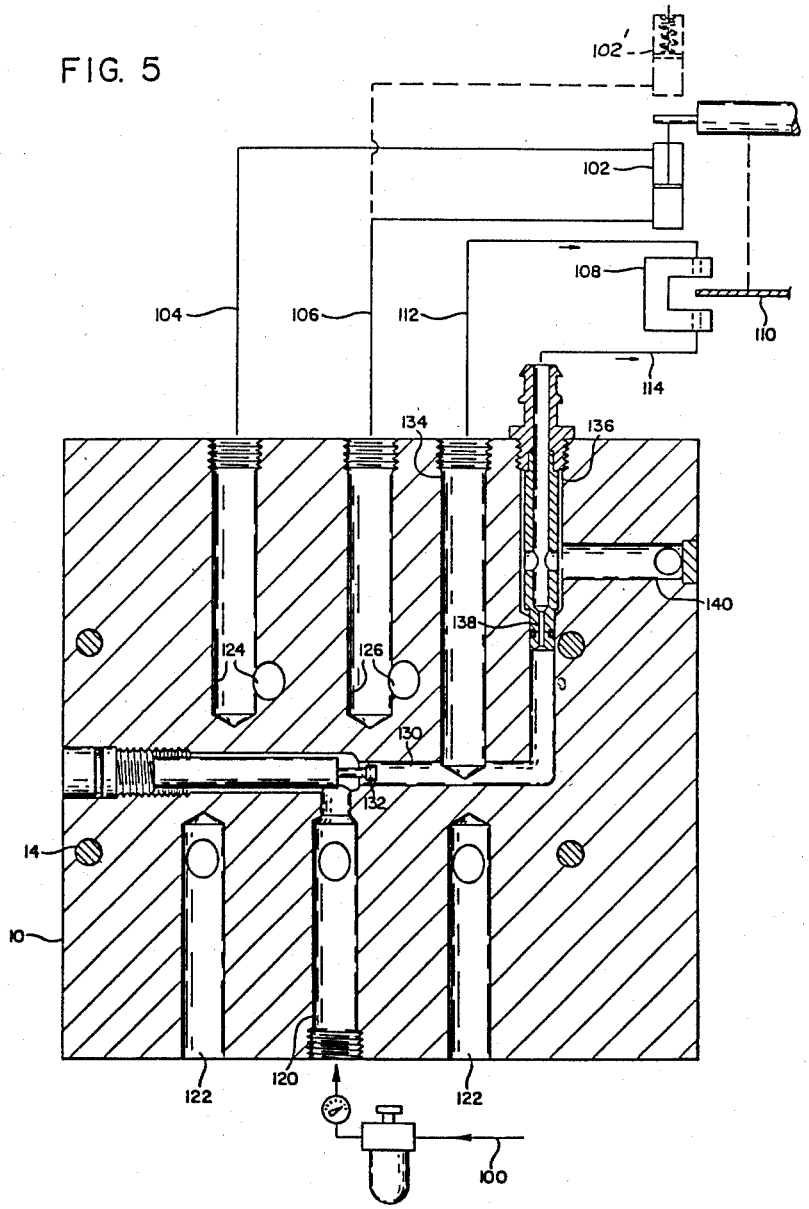

The valve of the invention comprises an assembly of a subbase 10 having a base 12 secured thereto, as by screws 14, FIG. 5, in turn supporting front and rear walls 16 and 18, respectively, fastened thereto by screws 20. Walls 16 and 18 have inturned top portions 22 which clamp a top wall 24 therebetween by means of elongated screws 26. Side walls 28 are secured to the front and rear walls by screws 30. The top surface **12*a* of base 12** comprises a machined surface.

A first rear upright plate 36 is secured to the exterior of rear wall 18, by screws 38, and a second upright plate 40 is secured to the rear of plate 36, as by screws 42.

These plates seat on a notched portion 44 of the base 10 and have cooperating recesses to form a diaphragm chamber 46 enclosing a thin, flexible diaphragm 48 securely clamped between the upright plates 36 and 40. Diaphragm 48 has a reinforcing body portion 50 integral therewith.

A control member or block 54 is suspended from the top of the housing by a pair of leaf springs 56 and has clearances at its ends for controlled movement in the housing. These leaf springs are clamped between the inturned portions 22 of the walls 16 and 18 and the top wall 24. The bottom portions of the leaf springs are clamped between end plates 58 of the control member secured, as by screws 60, to such control member. The end plates 58 have an upright extension 62, and one of these end extensions is secured to the body portion 50 of the diaphragm by a horizontal rod 64 passing freely through a bore 66 in wall 18 and plate 36. The upright extension 62 at the other end of the housing is engaged by a biasing spring 70 made variable in its force by an adjusting screw 72 in the front wall.

The bottom surface 54*a* of control member 54 comprises a machined surface and has a pair of enlarged inverted cup-shaped circular recesses 76 and 78 spaced a short distance apart and also spaced inwardly from the respective ends of the control member 54. These recesses are associated with inserts 80 and 82, respectively, fitted in bores 84 in the base 12. Insert 80 has an upright bore or passageway 86 associated with recess 76 and insert 82 has an upright bore or passageway 88 associated with recess 78. Cutting of the recesses 76 and 78 comprises an extension of the cutting step of bores 84 for the plugs, as will be more apparent hereinafter.

Figure 1:
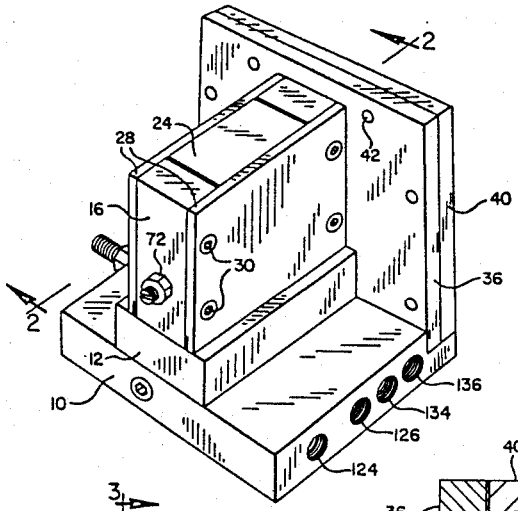
FIG. 1 is a perspective view of a servo valve incorporating features of the present invention.
Figure 2:
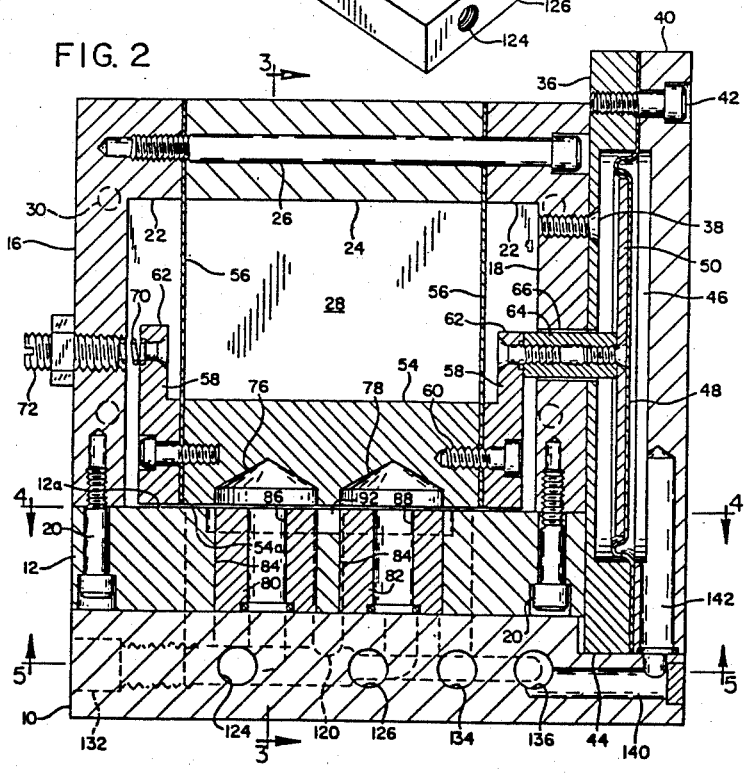
FIG. 2 is a longitudinal vertical sectional view of the valve taken on the line 2—2 of FIG. 1.
Figure 3:
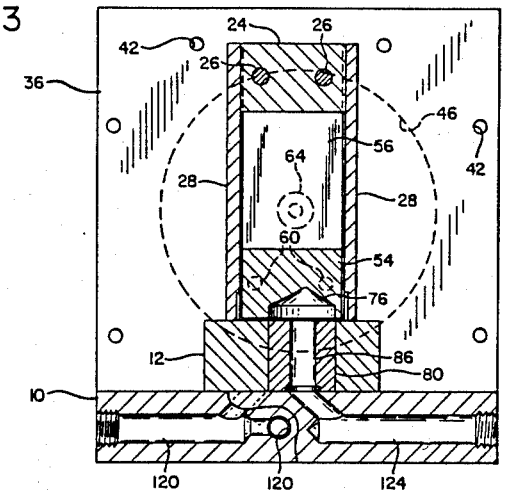
FIGS. 3, 4 and 5 are sectional views taken on the lines 3—3, 4—4, and 5—5 of FIG. 2, respectively.
Figure 4:
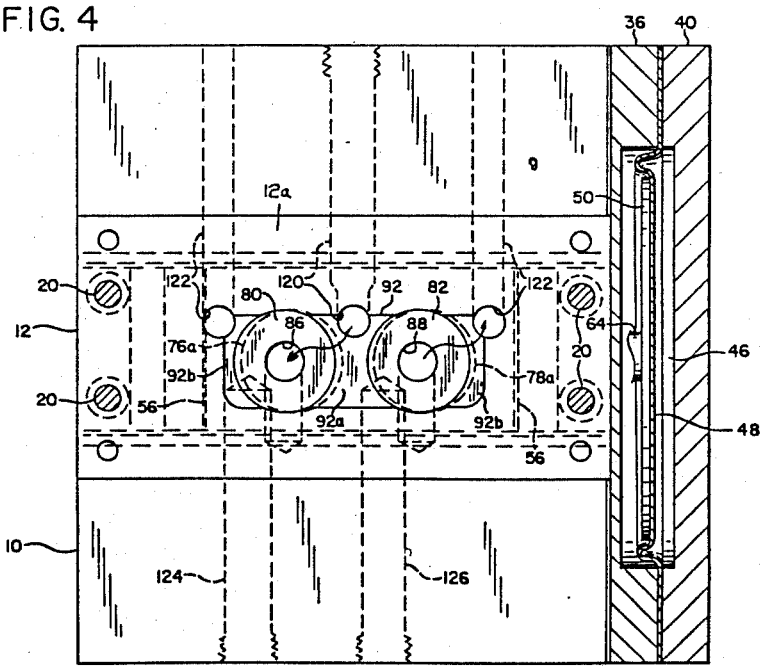

With particular reference to FIGS. 2 and 4, inserts 80 and 82 project inwardly into a recess 92 cut in the top surface 12*a* of base 12. This recess has a central portion 92*a* between the inserts 80 and 82 and extends beyond the ends of the inserts 80 and 82 to form end portions 92*b*. Recess 92 has a contoured fitted association with the sides of the inserts.

The present valve is arranged to be associated with an air pressure system 100, FIG. 5, for adjusting a piston operated actuator means 102 by suitable connecting air lines or conduits 104 and 106 under the control of a sensor 108 associated with a traveling web 110. Sensor 108 has an air input line 112 and a pressure signal line 114 the pressure in which is altered by the lateral position of the web 110 whereby response of the actuator means 102 through the valve under the influence of the sensor 108 will adjust a mechanism according to lateral movement of the web as is well known in the art.

Porting of the valve to accomplish operation of the actuator means 102 in response to the sensor 108 comprises a pressure inlet passageway 120 which leads from a suitable connection, not shown, with the air pressure system 100 through the subbase 10 and base 12 to the recess area 92*a* between the inserts 80 and 82. Recess areas 92*b* at the ends of the recess 92 are in communication with exhaust passageways 122 for the respective inserts which lead from these respective recess portions through the base 12 and subbase 10 to atmosphere. Lines 104 and 106 from the actuator means 102 are connected, by suitable fittings, not shown, to passageways 124 and 126, respectively, leading inwardly through the subbase 10 into the lower end of respective bores 86 and 88. Pressure existing in the passageway 120 is stopped at the control member 54 when it is centered over the inserts 80 and 82 but upon lateral movement of the control member, it will allow pressure therefrom to flow through one or the other of the bores 86 and 88 for adjusting the actuator means 102, the exhaust from the actuator means flowing through the other bore 86 or 88 into its exhaust passageway 122.

Pressure inlet passageway 120 also communicates with a passageway 130 having a flow restricting valve 132 projecting into it for reducing the flow in the passageway 130. Passageway 130 has two branch passageways 134 and 136. Passageway 134 is connected to one side of the sensor 108 by the line 112 and passageway 136 is connected to the other side of the sensor by the line 114. A flow restricting valve 138 is mounted in the branch passageway 136 and provides a low flow to prevent the entry of contaminants from the air surrounding sensor 108 from entering the line 114. A branch passageway 140 in the subbase 10 has an upward extension 142 in the rear wall portion 36, 40 in communication with the diaphragm chamber 46.

The restricting valve 132 provides a low pressure system for the sensor 108 and the restricting orifice 138 in turn provides the small purge flow in the low pressure sensor circuit as will now be more fully described.

Suspension of the valve member 54 in the initial setting of the valve is made so that the recesses 76 and 78 precisely are in alignment over the inserts 80 and 82, respectively. Such precision suspension is accomplished by adjustment of the adjustment screw 72 to position the member 54 in lateral balanced relation with the pressure in the diaphragm chamber 46. In such balanced position of the valve member 54, no appreciable amount of air flows between inlet passageway 120 and either of the bores 80 or 82. However, as the web 110 shifts laterally, the influence of the line 114 in the sensor will change and the diaphragm will shift the member 54 one way or the other for producing a following movement of the actuator means 102. For example, an inward movement of the web 110 into the sensor will decrease the influence of the high pressure side 112 on the lower pressure side 114 whereby the diaphragm will be moved to the right under the action of the biasing spring 70 so as to shift the member 54 to the right. This will put pressure from passageway 120 through recess 76, bore 80 and passageway 124 to the one side of the actuator means 102. In such movement, the actuator exhausts through line 106, passageway 126, bore 82, and its passageway 122. If the web should shift in a direction away from the sensor, the recess 78 and associated structure comes into play for opposite movement.

One important feature of the present valve comprises the leaf spring suspension of the valve member 54. The member 54 is suspended a minute clearance above the surface 12*a* so that while providing a fairly good seal for air flow at the same time provides free movement of the block from the diaphragm. Since the member 54 does not bear against the surface 12*a*, there is no wear and also small dust particles will not affect efficient operation of the valve.

The flexibility of the leaf springs allows the high response desired for use with a low signal pressure. According to the invention, also, the leaf springs being of uniform thickness and of known characteristics, are predictably and analytically engineered and tested precisely, considering the compression or columnar force acting endwise thereon as a result of the working pressure and at the same time allowing their necessary lateral deflection for operation of the control member 54 without buckling. These computations also must consider the material from which the leaf springs are constructed as well as their thickness, the size of the valve, etc. Also, the control member 54 is of light weight so that it will never be under tension when the valve is in operation.

Another feature of the valve is that the cup-shaped recesses 76 and 78 as well as the inserts 80 and 82 are enlarged and provide a maximum flow of driving power to the actuator means 102 with a minimum movement of the valve block 54. That is, as seen in FIG. 4 and designated by the numerals 76*a* and 78*a* which designate an adjusted position of the recesses 76 and 78, respectively, a substantially large segment of recess is opened up for power flow and exhaust. The valve is thus highly responsive in its function by minimum movement of member 54. Also, the valve is highly responsive to the low pressure signal of the sensor, such low pressure allowing use of the valve with thin or fragile webs 110.

Still another feature of the valve is the relationship that the hollow inserts 80 and 82 have with the recesses 76 and 78, respectively. By such arrangement, the valve can be precisely constructed during manufacture in that with suitable anchoring of the block 54 within the valve, the bores for insertion of the inserts and for cutting of the recesses can be accomplished in one step. Thus, misalignment of the valve parts in manufacture is remote. However, the bores 84 for the plugs 80 and 82 can be reamed larger than the recesses 76 and 78 after the control block assembly 54 has been removed. In such case, the plugs will be slightly larger than their respective recesses which will tend to reduce leakage.

The valve can be disassembled and reassembled without having to use a fragile shim in the final assembly, as required in previous designs. In the subject valve, the shim for determining the clearance between the moving and stationary parts is used to space the parts while the ports are being drilled and reamed, with the parts firmly clamped together. The suspension springs are permanently clamped to their supports and their fasteners are sealed. The shims are then discarded after the ports are machined. Another feature of the invention is that all the portage is enclosed within the housing and therefore is not subject to external damage.

It is to be understood that the form of my invention herein shown and described is to be taken as a preferred example of the same and that various changes in the shape, size and arrangement of parts may be resorted to without departing from the spirit of my invention, or the scope of the subjoined claims. For example, the above description associates the valve with a double acting actuator 102 whereas the valve can as well be associated with a single acting actuator. Such is illustrated in phanton lines in FIG. 5 wherein one of the lines, such as line 106, can lead to one side of a single acting piston type actuator 102' having spring return.

Having thus described my invention, I claim:

1. A servo valve for controlling output pneumatic power to actuator means, said valve comprising (a) a housing having an inner area defined by end walls, side walls, a top wall, and a bottom wall having a flat inner surface, (b) an inlet port opening through said flat inner surface, (c) outlet ports also opening through said surface, (d) pressure inlet means leading to said inlet port, said outlet ports being arranged to be connected to actuator means, (e) a control member in said housing having end walls secured removably thereto and also having a pair of recesses facing said inner surface in association with said inlet and outlet ports, (f) a pair of leaf springs secured in spaced relation from each other between said control member and its end walls and being secured to said top wall of said housing for suspending said control member in close but freely movable spaced relation from said flat inner surface, (g) a diaphragm mounted in one of said end walls of said housing controlled in its movement by a pneumatic correction low signal force from a sensor, (h) an extension on one of said end walls of said control member connected to said diaphragm, (i) said diaphragm operatively moving said control member laterally relative to said leaf springs under the influence of a pneumatic correction signal force from a sensor to selectively position said control member relative to said inlet and outlet ports for controlling power to actuator means, (j) said leaf springs being of uniform thickness and of known characteristics whereby to preselect their ability of lateral deflection capable of allowing movement of said control member by a low force from said movable pressure responsive drive means but having a compressive strength without buckling as a result of the compression of the force at said pressure inlet means against said control member.

2. The servo valve of claim 1 wherein said recesses are substantially larger in cross section than said ports and said ports comprise bores in plugs which are fitted in openings through said bottom wall and which form a seal between said inlet and outlet ports, the openings in said bottom wall for said plugs being of the same size and shape in cross section as said recesses so that in the formation of said valve, said recesses can be formed as a continuation of the openings through said bottom wall.

* * * * *